US009982379B2

(12) United States Patent
Tsai et al.

(10) Patent No.: US 9,982,379 B2
(45) Date of Patent: May 29, 2018

(54) DYEING DEVICE AND DYEING APPARATUS

(71) Applicant: Taiwan Textile Research Institute, New Taipei (TW)

(72) Inventors: Jung-Yu Tsai, New Taipei (TW); Chen-Chi Huang, New Taipei (TW); Chun-Chen Chen, New Taipei (TW)

(73) Assignee: Taiwan Textile Research Institute, New Taipei (TW)

( * ) Notice: Subject to any disclaimer, the term of this patent is extended or adjusted under 35 U.S.C. 154(b) by 175 days.

(21) Appl. No.: 14/941,696

(22) Filed: Nov. 16, 2015

(65) Prior Publication Data

US 2016/0244902 A1 Aug. 25, 2016

(30) Foreign Application Priority Data

Feb. 25, 2015 (TW) ..... 104106034 A

(51) Int. Cl.

| | |
|---|---|
| ***D06F 23/04*** | (2006.01) |
| ***D06B 5/06*** | (2006.01) |
| ***D06P 1/94*** | (2006.01) |
| ***D06B 23/10*** | (2006.01) |
| ***D06B 23/14*** | (2006.01) |

(Continued)

(52) U.S. Cl.

CPC ..... *D06B 23/042* (2013.01); *D06B 5/06* (2013.01); *D06B 23/10* (2013.01); *D06B 23/14* (2013.01); *D06P 1/94* (2013.01); *D06P 5/2055* (2013.01); *D06B 2700/14* (2013.01); *D10B 2331/04* (2013.01)

(58) Field of Classification Search

CPC ..... D06B 23/10; D06B 23/14; D06B 23/042; D06P 1/94; D06P 5/2055

See application file for complete search history.

(56) References Cited

U.S. PATENT DOCUMENTS 3,914,964 A * 10/1975 Dietrich ..... B01F 13/0818 68/189
4,899,558 A * 2/1990 Suess ..... D06B 23/10 68/15
5,267,455 A 12/1993 Dewees et al.

(Continued)

FOREIGN PATENT DOCUMENTS

CN 2552541 5/2003
CN 1641088 7/2005

(Continued)

OTHER PUBLICATIONS

"Office Action of Taiwan Counterpart Application", dated Aug. 9, 2016, p. 1-p. 3, in which the listed references were cited.

(Continued)

*Primary Examiner* — Joseph L. Perrin
(74) *Attorney, Agent, or Firm* — JCIPRNET

(57) ABSTRACT

A dyeing device adapted to move in a high pressure space having a fluid is provided. The dyeing device includes a magnetic dyeing shaft and a dye mixing chamber connected to the magnetic dyeing shaft. The magnetic dyeing shaft is configured to make a fiber product wind thereon, and the dye mixing chamber is configured to store dye, and the dye mixing chamber is adapted to let the fluid in the high pressure space flow through. A dyeing apparatus including the dyeing device is also provided.

24 Claims, 4 Drawing Sheets

(51) Int. Cl.
*D06B 23/04* (2006.01)
*D06P 5/20* (2006.01)

(56) References Cited

U.S. PATENT DOCUMENTS

| | | | | |
|---|---|---|---|---|
| 6,003,346 | A * | 12/1999 | Hsu | D06B 23/10 68/150 |
| 7,971,454 | B2 * | 7/2011 | Rapoport | D06B 23/10 68/213 |
| 2003/0066139 | A1 * | 4/2003 | Go | D06B 23/10 8/158 |
| 2005/0257572 | A1 * | 11/2005 | Van Schepdael | D06B 23/14 68/3 R |

FOREIGN PATENT DOCUMENTS

| | | |
|---|---|---|
| CN | 101021038 | 8/2007 |
| CN | 101413191 | 4/2009 |
| CN | 101824716 | 9/2010 |
| CN | 102535068 | 7/2012 |
| CN | 202450288 | 9/2012 |
| CN | 102733208 | 10/2012 |
| CN | 103215779 | 7/2013 |
| CN | 203292140 | 11/2013 |
| JP | 2003082572 | 3/2003 |
| SU | 487665 | 10/1975 |
| TW | 512835 | 12/2002 |
| TW | 542263 | 7/2003 |
| TW | I229160 | 3/2005 |

OTHER PUBLICATIONS

"Office Action of China Counterpart Application," dated Dec. 4, 2017, p. 1-p. 9, in which the listed references were cited.

* cited by examiner

DYEING DEVICE AND DYEING APPARATUS

CROSS-REFERENCE TO RELATED APPLICATION

This application claims priority to Taiwanese patent application serial no. 104106034, filed on Feb. 25, 2015. The entirety of the above-mentioned patent application is hereby incorporated by reference herein and made a part of this specification.

BACKGROUND

Field of the Invention

The invention relates to a dyeing device and a dyeing apparatus, and more particularly, to a dyeing device and a dyeing apparatus adapted to be used in a high pressure environment.

Description of Related Art

In current society which pursues environmental protection, industries are all hoping to reduce waste in the production process, to use renewable materials or energy if possible, and to better handle post production waste for recycling and reuse. In a traditional dyeing process, water is used as a medium, wastewater produced after dip-dyeing contains heavy metals and organic dyeing additives which are difficult to decompose, and water pollution caused by the wastewater containing the aforesaid chemical substances results in a tremendous pressure for the recovery of nature and ecological environment.

Supercritical fluid dyeing is a highly anticipated environmental-friendly technology among the current dyeing techniques. A normal substance will enter into a state of supercritical fluid (SCF) when the temperature and the pressure thereof exceed the critical temperature and the critical pressure. The SCF is characterized in having a low viscosity, a high diffusion coefficient, and a low surface tension (which are similar to gas), and also having a high density and a high dissolution capability (which are similar to liquid); wherein different substances will have different chemical properties after being turned into SCFs. For example, the dissolution capability of the SCF will change with changes in temperature and pressure in the environment, and carbon dioxide may be increased in oleophilicity after entering into the state of SCF (and thereby has an ability to dissolve organic matter). Therefore, supercritical carbon dioxide may dissolve a nonpolar dye and may easily infiltrate into porous structures with the characteristic of the SCF having a low surface tension. Carbon dioxide SCF dyeing does not require using water as the medium and is non-toxic, and thus is capable of resolving the problem of environmental pollution caused by conventional dyeing processes, such as wastewater pollution.

In the conventional carbon dioxide SCF dyeing process, carbon dioxide fluid from a high pressure steel cylinder forms the carbon dioxide SCF through adjusting the temperature and the pressure. Next, the carbon dioxide SCF flows through a dye container to dissolve a dye, and the carbon dioxide SCF with the dissolved dye is then placed into a dyeing trough, which is placed with a fabric. In the aforesaid conventional dyeing process, the carbon dioxide SCF and the dye are required to flow through a high pressure pipeline to reach the dyeing trough. Thus, in addition to complicating the structure of process equipment, troublesome procedures for cleaning the high pressure pipeline and the dye container after the dyeing process staining system are needed. As the high-pressure pipelines and processing are required, the overall process efficiency is low, and may even affect the yield of dyeing products.

SUMMARY

The invention is directed to a dyeing device capable of providing a favorable dyeing effect in a high pressure space.

The invention is directed to dyeing apparatus capable of providing a favorable dyeing effect in a single chamber.

In some embodiments, the dyeing device of the invention is adapted to move in a high pressure space having a fluid. The dyeing device includes a magnetic dyeing shaft and a dye mixing chamber connected to the magnetic dyeing shaft. The magnetic dyeing shaft is configured to be wrapped by a fiber product, the dye mixing chamber is configured to store a dye, and the dye mixing chamber allows the fluid in the high pressure space to flow through.

Some embodiments of the dyeing apparatus of the invention include a dyeing device, a high pressure steel module accommodating the dyeing device and the fluid, and a magnetic unit. The high pressure steel module includes a cover body and a high pressure accommodating chamber, and the high pressure accommodating chamber and the cover body are configured to form the high pressure space. The magnetic unit provides a magnetic force to the high pressure space, and the magnetic force allows the magnetic dyeing shaft to move in the high pressure space along a desired direction.

In an embodiment of the invention, the dye mixing chamber includes a chamber and at least one first through hole. The dye is disposed in the chamber, the at least one first through hole connects the chamber with the high pressure space, and the at least one first through hole allows the fluid to flow in and out of the chamber.

In an embodiment of the invention, the dye mixing chamber further includes a filter layer covering the at least one first through hole.

In an embodiment of the invention, the magnetic dyeing shaft includes a hollow spool, a magnetic element located inside the hollow spool, and a connecting surface. The hollow spool allows the fiber product to wrap around a central shaft. The connecting surface is located on a top side of the hollow spool and connects the hollow spool with the dye mixing chamber, and the connecting surface has at least one second through hole, which allows the fluid to flow therethrough.

In an embodiment of the invention, a flowing compartment is formed between the hollow spool and the magnetic element, and the flowing compartment is wrapped around the central shaft by the hollow spool and connected to the high pressure space through an end of the flowing compartment, which is distal to the connecting surface.

In an embodiment of the invention, the at least one second through hole is connected to the flowing compartment.

In an embodiment of the invention, the hollow spool has a plurality of third through holes on a surface thereof and connecting with the flowing compartment.

In an embodiment of the invention, the magnetic dyeing shaft further includes at least one one-way valve connected to the through hole to control a flowing direction of the fluid via the at least one second through hole.

In an embodiment of the invention, the dyeing device further includes a connecting unit connecting the magnetic dyeing shaft and the dye mixing chamber.

In an embodiment of the invention, the connecting unit includes a first end and a second end. The first end has a thread to connect with the magnetic dyeing shaft, and the second end has a thread to connect with the dye mixing chamber.

In an embodiment of the invention, the fluid is a supercritical fluid.

In an embodiment of the invention, the fiber product is a knitted fabric, a woven fabric, a non-woven fabric or a yarn.

In an embodiment of the invention, a periphery of the connecting surface and an inner surface of the high pressure accommodating chamber are movably connected with each other.

In an embodiment of the invention, the dyeing apparatus further includes a safety valve located at the high pressure accommodating chamber and connected to the high pressure space. The safety valve is configured to be opened when a pressure in the high pressure space reaches a safety threshold.

In view of the above, in some embodiments, the dyeing device of the invention is adapted to move in the high pressure space and includes the dye mixing chamber to allow the fluid and the dye in the high pressure space to be directly mixed with each other, and thus provides the fiber product on the magnetic dyeing shaft with favorable dyeing effect. The dyeing apparatus in the embodiment of the invention can complete the mixing of the dye and the dying of the fiber fabric directly in the high pressure space without requiring other pipeline.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
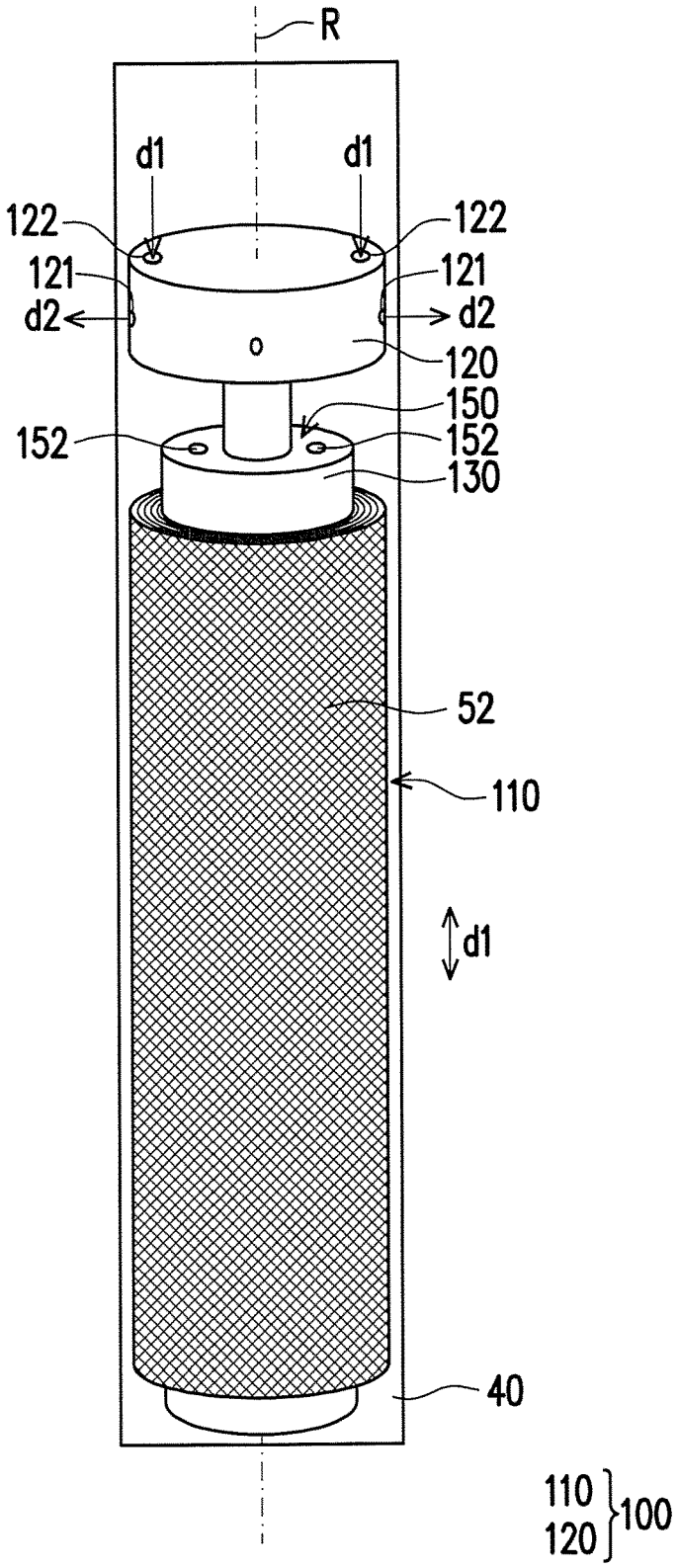
FIG. 1A is a schematic diagram illustrating a dyeing device and a fiber fabric according to a first embodiment of the invention.
Figure 1B:
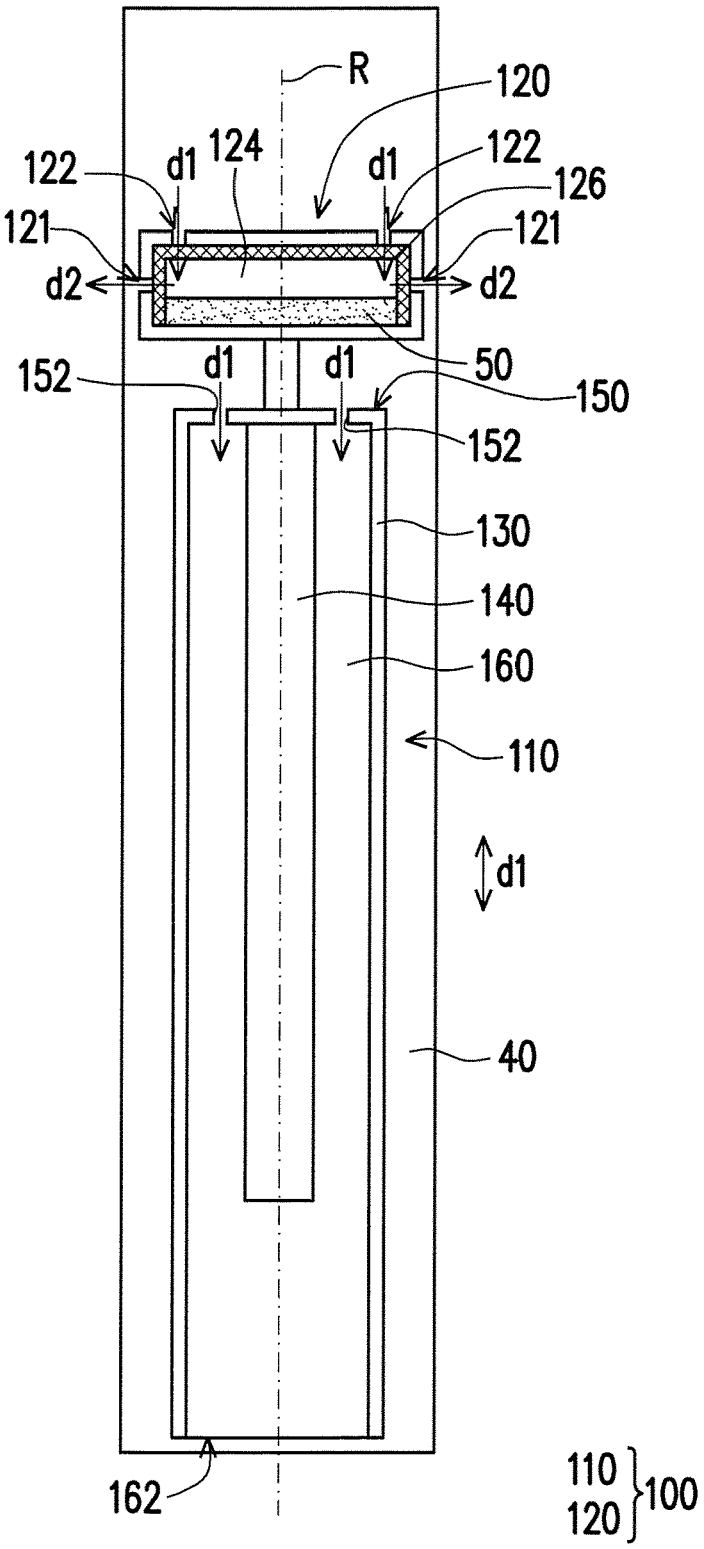
FIG. 1B is a cross-sectional diagram illustrating the dyeing device according to the first embodiment of the invention.

FIG. 1A is a schematic diagram illustrating a dyeing device and a fiber fabric according to a first embodiment of the invention. Referring to FIG. 1A, in the first embodiment of the invention, dyeing device 100 is adapted to move in a high pressure space 40 having a fluid, and the dyeing device 100 includes a magnetic dyeing shaft 110 and a dye mixing chamber 120 connected with each other. FIG. 1B is a cross-sectional diagram illustrating the dyeing device according to the first embodiment of the invention. Referring to FIG. 1B, in the present embodiment, the dye mixing chamber 120 is configured to store a dye 50, and the dye mixing chamber 120 allows the fluid to flow in and out of the high pressure space 40. Thus, the fluid in the high pressure space 40 can dissolve the dye 50 when flow through the dye mixing chamber 120. More specifically, the fluid in the high pressure space 40 may contact the dye 50 when flowing through the dye mixing chamber 120, and thus the fluid and the dye 50 may form a solution with dyeing function, wherein the fluid is a solvent and the dye 50 is a solute.

For example, the dyeing device 100 of the present embodiment allows the fluid in the high pressure space 40 to flow into the dye mixing chamber 120 along a first direction d1, so the dye 50 is dissolved by the fluid flowing into the dye mixing chamber 120, such that the fluid can serve as a carrier of the dye 50 to allow the dye 50 to flow out of the dye mixing chamber 120 along a second direction d2 or along a direction which is parallel, but opposite to, the first direction d1. Therefore, the dye mixing chamber 120, in which the dye 50 is being stored, allows the fluid flowing thereby to dissolve the dye 50. At the same time, since the dyeing device 100 is adapted to move in the high pressure space 40 having the fluid, the dyeing device 100 also stirs the flow of the fluid while moving in the high pressure space 40 and thereby allows the dye 50 to be dissolved in the fluid more easily.

In the present embodiment, the magnetic dyeing shaft 110 is configured to be wrapped by a fiber product 52 thereon, and when the dyeing device 100 moves in the high pressure space, the fiber product 52 wrapping around the magnetic dyeing shaft 110 can be dyed with the dye 50 that is dissolved by the fluid. In simple terms, the dyeing device 100 of the present embodiment can move in the high pressure space 40, and the fluid in the high pressure space 40 can form a dye fluid by flowing through the dye mixing chamber 120 to dissolve the dye 50, so that the fiber product 52 on the magnetic dyeing shaft 110 can be dyed.

The dyeing device 100 of the present embodiment, when moving in the high pressure space 40, allows the dye 50 to be dissolved by the fluid in a single high pressure space 40 while dying the fiber product 52, and thereby provides an easy-to-operate dyeing method.

In the present embodiment, the fluid in the high pressure space 40 is, for example, a supercritical fluid, such that the temperature and the pressure in the high pressure space 40 both exceed a critical temperature and a critical pressure of a substance, thus causing the substance to form a supercritical fluid in the high pressure space 40. The dyeing device 100 of the present embodiment is adapted to move in a high pressure environment, and the dye mixing chamber 120 of the dyeing device 100 is adapted to allow the supercritical fluid to flow therethrough so the dye 50 can be dissolved in the supercritical fluid. As a result, an easy-to-operate dyeing method in a high pressure environment is provided. Specifically, the dyeing device 100 of the present embodiment can provide an easy-to-operate supercritical fluid dyeing method.

More specifically, in the present embodiment, the fluid is, for example, carbon dioxide ($CO_2$), the temperature in the high pressure space 40 is, for example, between 0° C. to 150° C., and the pressure in the high pressure space 40 is, for example, between 0 kg/cm$^2$ to 500 kg/cm$^2$. In one embodiment of the invention, the temperature in the high pressure space is between 110° C. to 130° C. and the pressure in the high pressure space is between 240 kg/cm$^2$ to 300 kg/cm$^2$, but the invention is not limited thereto.

On the other hand, in the present embodiment, directions for the fluid to flow in and out of the dye mixing chamber 120 are not limited to the aforementioned first and second directions d1 and d2; that is to say, the aforementioned directions d1 and d2 are merely provided for explaining an exemplary flowing path for the fluid in the dye mixing chamber 120, but the invention is not limited thereto. In detail, referring to FIG. 1B, in the first embodiment of the invention, the dye mixing chamber 120 includes a chamber 124 and a plurality of through holes 121 and 122. The dye 50 is disposed in the chamber 124, the through holes 121 and 122 connect the chamber 124 with the high pressure space 40, and the through holes 121 and 122 allow the fluid in the high pressure space 40 to flow in and out of the chamber 124, but the invention does not limit a flowing direction of the fluid in each of the through holes 121 and 122. The through holes 122 of the present embodiment are located at a surface of the dye mixing chamber 120 which is distal to the magnetic dyeing shaft 110, and the through holes 121 are located at a side surface of the dye mixing chamber 120, wherein the side surface is perpendicularly connected to the surface at which the through holes 122 are located, but the invention is not limited thereto.

In the present embodiment, the dye mixing chamber 120 may further include a filter layer 126 covering the through holes 121 and 122. The filter layer 126 can block the dye 50 from directly flowing through the through holes 121 and 122, so as to prevent the dye 50 from directly contacting areas outside of the chamber 124, and thus the fiber product 52 dyed by the dyeing device 100 is able to maintain a favorable quality.

Referring to FIG. 1A and FIG. 1B, in the first embodiment of the invention, the magnetic dyeing shaft 110 includes a hollow spool 130, a magnetic element 140 located inside of the hollow spool 130, and a connecting surface 150. A material of the magnetic element 140 includes, for example, ferrite, alnico, neodymium or other ferromagnetic or ferrimagnetic material, and thus when an external magnetic field is applied to the dyeing device 100, the magnetic element 140 fixed on the dyeing device 100 actuates the dyeing device 100.

The hollow spool 130 is adapted to enable the fiber product 52 to wrap around a central shaft R. Specifically, the hollow spool 130 of the present embodiment has a side surface, and the side surface surrounds the central shaft R so that the fiber product 52 can wrap around the side surface along the central shaft R. The connecting surface 150 is located on a top side of the hollow spool 130, the connecting surface 150 connects the hollow spool 130 with the dye mixing chamber 120, and the connecting surface 150 has at least one through hole 152. The through hole 152 allows the fluid in the high pressure space 40 to flow therethrough. Namely, the connecting surface 150 is located between the hollow spool 130 and the dye mixing chamber 120. After the fluid in the high pressure space 40 firstly flows through the through holes 121 and 122 and dissolves the dye 50, the through hole 152 on the connecting surface 150 allows the fluid with dissolved dye 50 to flow therethrough along, for example, the first direction d1, so as to dye the fiber product 52 wrapped around the hollow spool 130.

Referring to FIG. 1B, a flowing compartment 160 is formed between the hollow spool 130 and the magnetic element 140 of the present embodiment. The hollow spool 130 wraps around the flowing compartment 160 along the central shaft R, and an end 162 of the flowing compartment 160, which is distal to the connecting surface 150, is connected to the high pressure space 40. That is to say, when the dyeing device 100 moves along, for example, the first direction d1, the fluid that dissolved the dye 50 and entered the flowing compartment 160 from the through hole 152 may flow from the end 162 of the flowing compartment 160 to the high pressure space 40 nearby the hollow spool 130, so the fiber product 52 wrapped around the hollow spool 130 can be dyed favorably. In simple terms, the through hole 152 of the present embodiment is connected to the flowing compartment 160, but the invention is not limited thereto. In the present embodiment, the hollow spool 130 is perpendicularly connected with the connecting surface 150 along a periphery of the connecting surface 150; that is to say, a cross-sectional area of the hollow spool 130, which is perpendicular to the central shaft R, is the same as an area of the connecting surface 150. However, in other embodiments of the invention, a cross-sectional area of the hollow spool, which is perpendicular to the central shaft, may be smaller than an area of the connecting surface.

In the first embodiment of the invention, the fiber product 52 is, for example, a knitted fabric, a woven fabric, a non-woven fabric or a yarn. That is to say, the magnetic dyeing shaft 110 of the dyeing device 100 of the first embodiment may be wrapped by the knitted fabric, the woven fabric, the non-woven fabric or the yarns, so as to be dyed by the supercritical fluid solution having the dye 50 in the high pressure space 40, thereby providing a convenient dyeing method.

Figure 2A:
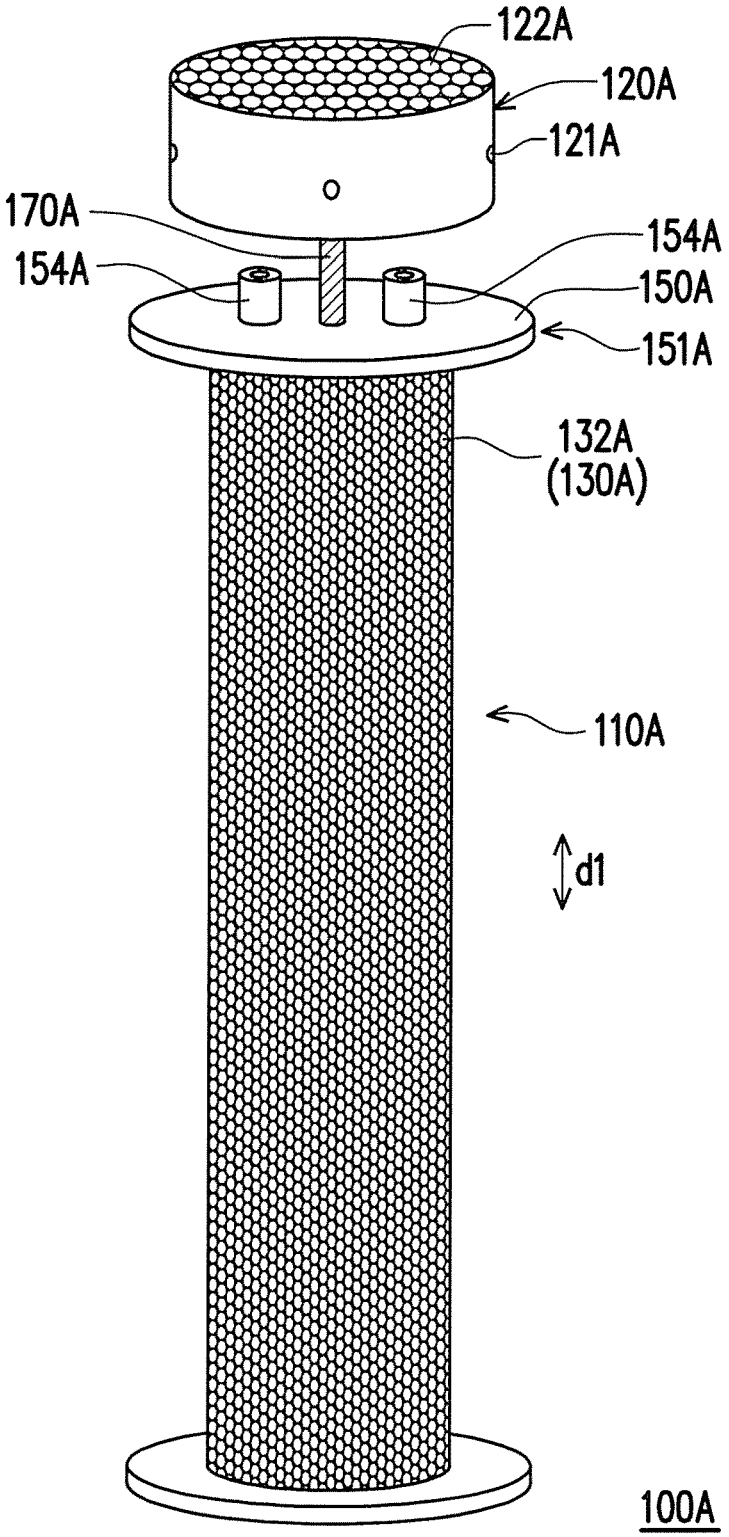
FIG. 2A is a schematic diagram illustrating a dyeing device according to a second embodiment of the invention.
Figure 2B:
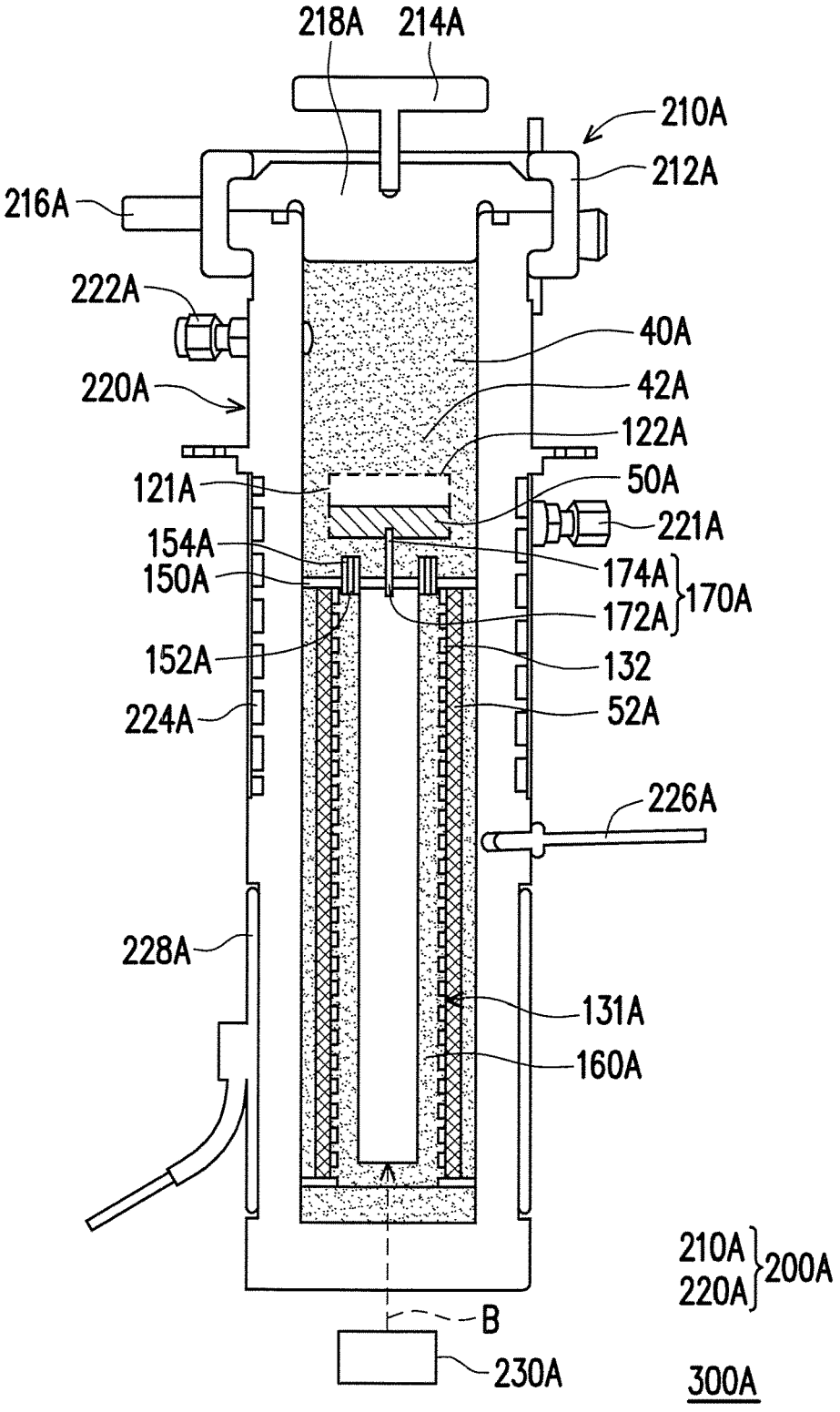
FIG. 2B is a cross-sectional diagram illustrating a dyeing apparatus including the dyeing device of FIG. 2A.

FIG. 2A is a schematic diagram illustrating a dyeing device according to a second embodiment of the invention. FIG. 2B is a cross-sectional diagram illustrating a dyeing apparatus including the dyeing device of FIG. 2A. It is to be noted that the following embodiment has adopted element notations and part of the contents from the previous embodiment, wherein the same notations are used for representing the same or similar elements, and descriptions of the same technical contents are omitted. The descriptions regarding the omitted part may be referred to the previous embodiment, and thus are not repeated herein. Referring to FIG. 2A and FIG. 2B, a dyeing apparatus 300A includes a dyeing device 100A, a high pressure steel module 200A accommodating the dyeing device 100A and a fluid 42A, and a magnetic unit 230A. The high pressure steel module 200A includes a cover body 210A and a high pressure accommodating chamber 220A, and the high pressure accommodating chamber 220A and the cover body 210A are configured to form a high pressure space 40A for accommodating the dyeing device 100A and the fluid 42A.

The dyeing device 100A of the present embodiment and the dyeing device 100 of the first embodiment are generally similar, but main differences between the two lie in that: the hollow spool 130A has a plurality of through holes 132A, and the through holes 132A are connected to the flowing compartment 160A and a surface 131A of the hollow spool 130A; the magnetic dyeing shaft 110A further includes at least one one-way valve 154A, and the one-way valve 154A is connected to the through hole 152A; the dye mixing chamber 120A has a plurality of through holes 122A; and the dyeing device 100A further includes a connecting unit 170A which connects the magnetic dyeing shaft 110A and the dye mixing chamber 120A.

In the present embodiment, the through holes 132A allow the fluid 42A to flow from the flowing compartment 160A towards the surface 131A of the hollow spool 130A, so that a flux of the fluid 42A between the flowing compartment 160A and the high pressure space 40A is increased, which thereby allows the fiber product 52A wrapped on the hollow spool 130A to be adequately dyed by the solution containing the dye 50A and the fluid 42A.

In the present embodiment, the one-way valve 154A controls a flowing direction in the through holes 152A for the fluid 42A in the high pressure space 40A, so that the fluid 42A nearby the dye mixing chamber 120A can appropriately flow into the flowing compartment 160A.

A side of the dye mixing chamber 120A of the present embodiment, which is distal to the magnetic dyeing shaft 110A, has a plurality of through holes 122A, so the fluid can flow into the dye storage space in the dye mixing chamber 120A more easily.

In the present embodiment, the connecting unit 170A of the dyeing device 100A includes a first end 172A and a second end 174A. The first end 172A has a thread to connect with the magnetic dyeing shaft 110A, and the second end 174A has a thread to connect with the dye mixing chamber 120A. Specifically, the connecting unit 170A of the present embodiment is, for example, a screw, which allows the magnetic dyeing shaft 110A to be properly connected with the dye mixing chamber 120A.

The magnetic unit 230A of the present embodiment provides a magnetic force B to the high pressure space 40A, and the magnetic force B allows the magnetic dyeing shaft 110A to move in the high pressure space 40A along a direction d1. The magnetic unit 230A is, for example, an electromagnet or a permanent magnet, in which the magnetic force B provided to the magnetic dyeing shaft 110A will change over time (e.g., changing in the amount of current, angle or distance), and thus cause the dyeing device 100A to move back and forth in the high pressure space 40A along the direction d1 so as to facilitate the dissolution of the dye 50A and the dyeing of the fiber product 52A.

Furthermore, in the present embodiment, a periphery 151A of the connecting surface 150A and an inner surface of the high pressure accommodating chamber 220A are movably connected with each other. That is to say, the connecting surface 150A and the hollow spool 130A of the present embodiment are different from the previously-mentioned connecting surface 150 and hollow spool 130, such that an area of the connecting surface 150A is greater than a cross-sectional area of the hollow spool 130A, which is perpendicular to the direction d1. Namely, the connecting surface 150A is relatively more protrusive than the hollow spool 130A, and thus the periphery 151A of the connecting surface 150A, as being movably connected with the inner surface of the high pressure accommodating chamber 220A, may provide a favorable guiding function when the dyeing device 100A moves.

In the present embodiment, the dyeing apparatus 100A further includes a safety valve 221A disposed at the high pressure accommodating chamber 220A and connected to the high pressure space 40A. The safety valve 221A is configured to be opened when a pressure in the high pressure space 40A reaches a safety threshold. Specifically, the safety valve 221A may, for example, provide a pressure relief function when the pressure in the high pressure space 40A exceeds the safety threshold, so that the pressure in the high pressure space 40A of the high pressure steel module 200A in the dyeing apparatus 300A is maintained within a safety range.

In detail, the cover body 210A of the present embodiment further includes a clip cover 212A, a carrying handle 214A, a locking screw 216A and a lid 218A. The cover body 210A is configured to tightly seal with the high pressure accommodating chamber 220A to form the high pressure space 40A. The cover body 210A of the present embodiment can endure a pressure of 500 kg/cm$^2$, for example. The cover body in the embodiment of the invention is not limited to the aforementioned element structure, such that the configuration of each element may further be adjusted according to the structure of the high pressure accommodating chamber 220A and the amount of pressure in the high pressure space 40A. On the other hand, because the high pressure steel module 200A of the present embodiment is formed by tightly sealing the high pressure accommodating chamber 220A with the cover body 210A, the dyeing apparatus 300A of the present embodiment can be cleaned easily after the dyeing process by using the openable cover body 210A and the dyeing device 100A, which enables the dyeing process to be carried out in a single chamber.

The high pressure accommodating chamber 220A of the present embodiment further includes a one-way valve 222A, a water cooling conduit 224A, a sensing unit 226A and a heater 228A. The one-way valve 222A is configured to connect with a fluid supply device, and the one-way valve 222A ensures that the fluid 42A only flows into the high pressure space 40A and does not backflow into the other pipeline. The sensing unit 226A is configured to detect the temperature in the high pressure space 40A, which is heated by the heater 228A or cooled by the water cooling conduit 224A, but the invention is not limited thereto. In other embodiments, the sensing unit 226A may further monitor the pressure in the high pressure space 40A, so that the overall dyeing process can be safer. Because the dyeing apparatus 300A of the present embodiment includes the dyeing device 100A, the dye 50A and the fluid 42A are all kept in the high pressure space 40 during the process of dyeing the fiber product 52A, thereby providing an easy-to-operate and easy-to-clean dyeing process.

In an embodiment of the invention, a capacity of the high pressure steel module 200A is smaller than or equal to 700 ml, the high pressure steel module 200A is adapted to be filled with less than 400 g of carbon dioxide, and the hollow spool 130A is adapted to be wrapped by less than 50 g of the fiber product 52A. In another embodiment of the invention, the high pressure steel module is adapted to be filled with 300 g to 340 g of carbon dioxide, and the hollow spool is adapted to be wrapped by 13 g to 40 g of the fiber product.

In the following Table, data related to dyeing qualities of several Examples of the invention are provided for explaining effects of the dyeing device and the dyeing apparatus of the invention. In the following Examples, dyeing intensity and levelness values for the fiber products dyed by the dyeing apparatus 300A in the aforementioned second embodiment are listed in Table 1 below:

TABLE 1 evaluation of the dyeing intensity and the levelness of the dyeing apparatus

| Experimental group | | Data group | | | | | | | |
|---|---|---|---|---|---|---|---|---|---|
| number | Test values | 1 | 2 | 3 | 4 | 5 | 6 | 7 | 8 |
| Example 1 | Gross apparent color intensity | 56.7 | 54.7 | 56.3 | 60.0 | | | | |
| | CMC color difference | Standard | 0.23 | 0.07 | 0.42 | | | | |

TABLE 1-continued evaluation of the dyeing intensity and the levelness of the dyeing apparatus

| Experimental group number | Test values | Data group 1 | 2 | 3 | 4 | 5 | 6 | 7 | 8 |
|---|---|---|---|---|---|---|---|---|---|
| Example 2 | Gross apparent color intensity | 75.3 | 75.6 | 76.2 | 79.5 | | | | |
| | CMC color difference | Standard | 0.10 | 0.18 | 0.46 | | | | |
| Example 3 | Gross apparent color intensity | 48.4 | 47.4 | 48.7 | 48.4 | 49.2 | 49.7 | 50.4 | 52.5 |
| | CMC color difference | Standard | 0.21 | 0.09 | 0.13 | 0.19 | 0.22 | 0.28 | 0.69 |
| Example 4 | Gross apparent color intensity | 95.5 | 96.5 | 96.8 | 100.9 | | | | |
| | CMC color difference | Standard | 0.11 | 0.12 | 0.45 | | | | |

The above-listed gross apparent color intensities (in unit of K/S) are gross apparent color intensities related to color depth and CMC color differences related to color difference measured by a Datacolor DC650 spectrometer with a large aperture, a D65 light source and an angle of 10 degrees. Each data group includes average values measured at four points in a plurality of regions sequentially arranged from the inside to the outside of the dyed fiber product, wherein data group 1 is at the most inner side.

In Example 1 of the invention, the fiber product is 15 g of a polyester knitted fabric which weighs 125 g/cm$^2$, the dye is 0.1% on-weight fabric (owf) of disperse dye C.I. Red 152, the amount of carbon dioxide is 310 g, and the fiber product is dyed for 60 minutes under a dyeing condition including a temperature of 120° C. and a pressure of 275 kg/cm$^2$.

In Example 2 of the invention, the fiber product is 14 g of a polyester knitted fabric which weighs 125 g/cm$^2$, the dye is 0.2% owf of disperse dye C.I. Red 152, the amount of carbon dioxide is 325 g, and the fiber product is dyed for 60 minutes under a dyeing condition including a temperature of 120° C. and a pressure of 265 kg/cm$^2$.

In Example 3 of the invention, the fiber product is 28 g of a polyester knitted fabric which weighs 125 g/cm$^2$, the dye is 0.1% owf of disperse dye C.I. Blue 291.1, the amount of carbon dioxide is 320 g, and the fiber product is dyed for 60 minutes under a dyeing condition including a temperature of 120° C. and a pressure of 240 kg/cm$^2$.

In Example 4 of the invention, the fiber product is 14 g of a polyester knitted fabric which weighs 125 g/cm$^2$, the dye is 0.2% owf of disperse dye C.I. Blue 291.1, the amount of carbon dioxide is 320 g, and the fiber product is dyed for 60 minutes under a dyeing condition including a temperature of 120° C. and a pressure of 290 kg/cm$^2$. It can be seen from Table 1 that, the differences between the gross apparent color intensities of the fiber fabrics dyed by the dyeing apparatus in the embodiment of the invention are extremely small, and all the CMC color difference values do not exceed 0.8. As a result, the dyeing apparatus in certain embodiments of the invention can provide a favorable dyeing effect.

In summary, in certain embodiments of the invention, the dyeing device includes the dye mixing chamber and the magnetic dyeing shaft that are connected with each other, and the dyeing device can complete the dyeing of a fiber product by moving in a single high pressure space. As a result, a simple dyeing method is provided. Because the dyeing apparatus may be applied with said dyeing device, the fluid used to dissolve the dye and the fluid solution having the dye are, in some embodiments, only presented in the high pressure steel module of the dyeing apparatus, and are not required to flow to another additional pipeline; therefore, in addition to providing a simple dyeing method, a dyeing apparatus being easy-to-clean or allowing easy dye changing can also be provided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A dyeing device configured to move in a high pressure space, comprising:

a magnetic dyeing shaft configured to be wrapped by a fiber product thereon; and a dye mixing chamber connected to the magnetic dyeing shaft and configured to store a dye, and the dye mixing chamber allowing a fluid in the high pressure space to flow through, wherein the magnetic dyeing shaft comprises a hollow spool wrapped around a central shaft by the fiber product, a magnetic element located inside the hollow spool, and a connecting surface on a top side of the hollow spool and connecting the hollow spool and the dye mixing chamber, and the connecting surface having the at least one second through hole to allow the fluid to flow therethrough.

2. The dyeing device according to claim 1, wherein the dye mixing chamber comprises:

a chamber configured to store the dye therein; and at least one first through hole which connects the chamber with the high pressure space to allow the fluid to flow in and out of the chamber.

3. The dyeing device according to claim 2, wherein the dye mixing chamber further comprises a filter layer, covering the at least one first through hole.

4. The dyeing device according to claim 1, wherein a flowing compartment is formed between the hollow spool and the magnetic element, and the flowing compartment is wrapped around the central shaft by the hollow spool and connected to the high pressure space through an end of the flowing compartment, which is distal to the connecting surface.

5. The dyeing device according to claim 4, wherein the at least one second through hole is connected to the flowing compartment.

6. The dyeing device according to claim 4, wherein the hollow spool has a plurality of third through holes on a surface thereof and connecting with the flowing compartment.

7. The dyeing device according to claim 1, wherein the magnetic dyeing shaft further comprises at least one one-way valve connected to at least one one-way valve connecting with the at least one second through hole to control a flowing direction of the fluid via the at least one second through hole.

8. The dyeing device according to claim 1, further comprising a connecting unit connecting the magnetic dyeing shaft and the dye mixing chamber.

9. The dyeing device according to claim 8, wherein the connecting unit comprises a first end and a second end, wherein the first end has a thread to connect with the magnetic dyeing shaft and the second end has a thread to connect with the dye mixing chamber.

10. The dyeing device according to claim 1, wherein the fluid is a supercritical fluid.

11. The dyeing device according to claim 1, wherein the fiber product is selected from a group consisting of a knitted fabric, a woven fabric, a non-woven fabric or a yarn.

12. The dyeing apparatus according to claim 1, wherein a flowing compartment is formed between the hollow spool and the magnetic element, and the flowing compartment is wrapped around the central shaft by the hollow spool and connected to the high pressure space through an end of the flowing compartment, which is distal to the connecting surface.

13. The dyeing apparatus according to claim 12, wherein the at least one second through hole is connected to the flowing compartment.

14. The dyeing apparatus according to claim 12, wherein the hollow spool has a plurality of third through holes on a surface thereof and connecting with the flowing compartment.

15. The dyeing apparatus according to claim 1, wherein the magnetic dyeing shaft further comprises at least one one-way valve connected to at least one one-way valve connecting with the at least one second through hole to control a flowing direction of the fluid via the at least one second through hole.

16. The dyeing apparatus according to claim 1, wherein a periphery of the connecting surface and an inner surface of the high pressure accommodating chamber are movably connected with each other.

17. A dyeing apparatus, comprising:

a high pressure steel module, comprising a cover body and a high pressure accommodating chamber to form a high pressure space, which is configured to accommodate a fluid;

a dyeing device configured to be accommodated in the high pressure accommodating chamber, and to move inside the high pressure space in a desired direction, the dyeing device comprising:

a magnetic dyeing shaft configured to be wrapped by a fiber product thereon; and a dye mixing chamber connected to the magnetic dyeing shaft and configured to store a dye, wherein the dye mixing chamber allows the fluid in the high pressure space to flow through the dye mixing chamber; and a magnetic unit configured to provide a magnetic force to the high pressure space, the magnetic force allowing the magnetic dyeing shaft in the high pressure space to move in the desired direction, wherein the magnetic dyeing shaft comprises a hollow spool wrapped around a central shaft by the fiber product, a magnetic element located inside the hollow spool, and a connecting surface on a top side of the hollow spool and connecting the hollow spool and the dye mixing chamber, and the connecting surface having at least one second through hole to allow the fluid to flow therethrough.

18. The dyeing apparatus according to claim 17, wherein the dye mixing chamber comprises:

a chamber configured to store the dye therein; and at least one first through hole which connects the chamber with the high pressure space to allow the fluid to flow in and out of the chamber.

19. The dyeing apparatus according to claim 18, wherein the dye mixing chamber further comprises a filter layer, covering the at least one first through hole.

20. The dyeing apparatus according to claim 17, further comprising a connecting unit connecting the magnetic dyeing shaft and the dye mixing chamber.

21. The dyeing apparatus according to claim 20, wherein the connecting unit comprises a first end and a second end, the first end has a thread to connect with the magnetic dyeing shaft and the second end has a thread to connect with the dye mixing chamber.

22. The dyeing apparatus according to claim 17, wherein the fluid is a supercritical fluid.

23. The dyeing apparatus according to claim 17, further comprising a safety valve located at the high pressure accommodating chamber and connected to the high pressure space, the safety valve being configured to be opened when a pressure in the high pressure space reaches a safety threshold.

24. The dyeing apparatus according to claim 17, wherein the fiber product is selected from a group consisting of a knitted fabric, a woven fabric, a non-woven fabric or a yarn.

* * * * *